US005589144A

United States Patent [19]

Filippi et al.

[11] Patent Number: 5,589,144

[45] Date of Patent: Dec. 31, 1996

[54] THERMAL BARRIER FOR AN EXHAUST SYSTEM

[76] Inventors: John E. Filippi, R.R. 1, Box 400, Negaunee, Mich. 49866; John A. Golen, 5765 Berwyn, Dearborn Heights, Mich. 48127

[21] Appl. No.: 517,305

[22] Filed: May 1, 1990

[51] Int. Cl.[6] ..... B01D 50/00; B23K 31/02

[52] U.S. Cl. ..... 422/179; 422/207; 422/211; 422/222; 422/239; 427/453; 228/176; 228/203

[58] Field of Search ..... 422/179, 177, 422/176, 207, 211, 222, 239; 423/213.2; 427/37; 228/203, 176

[56] References Cited

U.S. PATENT DOCUMENTS

| | | | |
|---|---|---|---|
| 3,969,082 | 7/1976 | Cairns et al. | 422/180 |
| 4,132,743 | 1/1979 | Castor et al. | 260/669 R |
| 4,318,894 | 3/1982 | Hensel et al. | 423/213.2 X |
| 4,536,371 | 8/1985 | Thayer et al. | 422/180 X |
| 4,755,360 | 7/1988 | Dickey et al. | 422/177 X |
| 4,849,247 | 7/1989 | Scanlon et al. | 427/37 |
| 4,930,678 | 6/1990 | Cyb | 228/176 |

OTHER PUBLICATIONS

Article "Cyb manifold draws attention"*Automotive News* Feb. 26, 1990 p. 16.

*Primary Examiner*—Nina Bhat
*Attorney, Agent, or Firm*—Bliss McGlynn, P.C.

[57] ABSTRACT

The present invention relates to a thermal barrier coating applied to the inside surface of a catalytic converter and intake pipe between the manifold of an internal combustion engine and the catalytic converter. The catalytic converter and intake pipes are generally formed in two halves to facilitate an effective means by which the thermal barrier coating can be sprayed onto the inside surface by an arc plasma source prior to combining the individual halves of the catalytic converter or intake pipe.

11 Claims, 2 Drawing Sheets

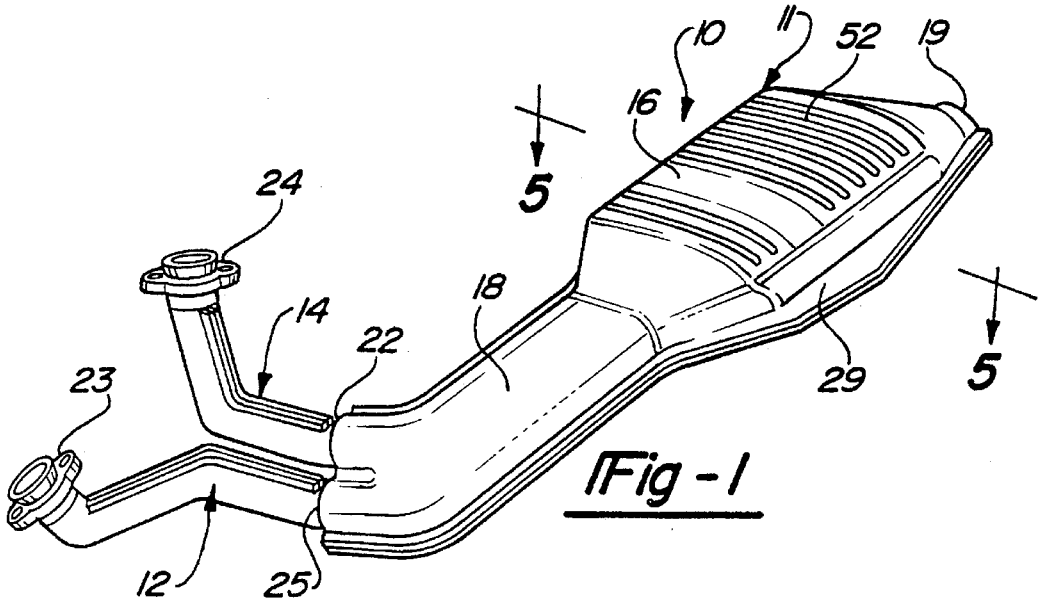
Fig - 1
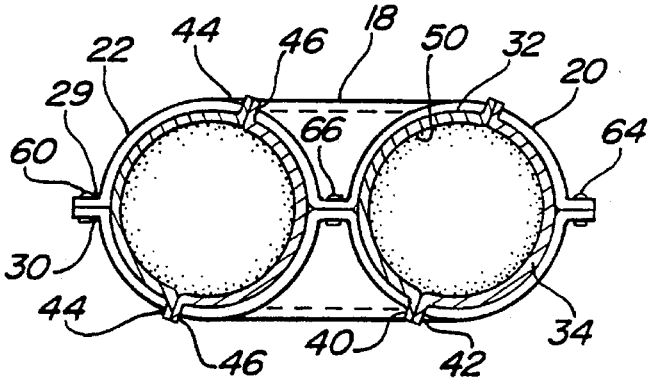
Fig - 3
Fig - 2
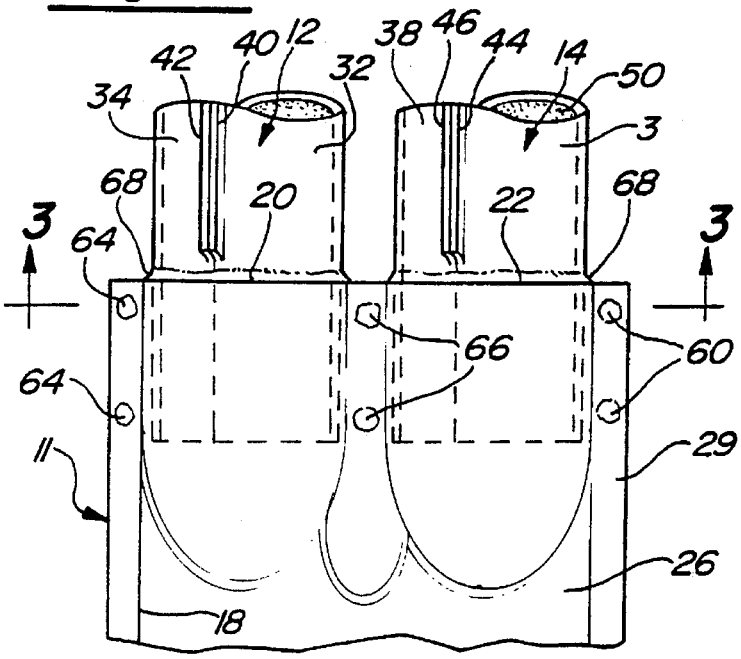

THERMAL BARRIER FOR AN EXHAUST SYSTEM

BACKGROUND OF THE INVENTION

1. Field of the Invention

The present invention relates generally to a thermal barrier, and more; specifically to a thermal barrier coating for covering the inside surface of an exhaust system.

2. Description of Related Art

Catalytic converters are used in exhaust systems of automotive vehicles. Exhaust gases from the engine are directed from manifolds of an internal combustion engine through exhaust intake pipes to the catalytic converter. In the catalytic converter, the exhaust gases pass through a catalyst substrate for converting environmentally harmful exhaust fumes into harmless by-products. To effectively and efficiently convert these exhaust fumes to the harmless by-products, the high temperatures of the exhaust fumes from the internal combustion engine must be maintained within the catalytic converter to obtain a higher rate of conversion. In a traditional catalytic converter, valuable heat of the exhaust gases is lost through the walls of the intake pipes and the walls of the catalytic converter itself. This is especially true when the internal combustion engine is first started because the exhaust system is cold. The decreased efficiency of the catalytic converter increases the probability that the automotive vehicle will not meet automotive emission standards.

Additionally, much of the heat lost through the walls of the catalytic converter and intake pipes is directed into the engine and/or passenger compartment of the automotive vehicle. This waste heat causes undesirable heating of the engine and/or passenger compartment, resulting in, for example, deterioration of parts and passenger discomfort. Previously, one solution to this waste heat problem resulted in placing a metal shield between the catalytic converter and intake pipes and the engine or passenger compartment. This solution provided a number of drawbacks such as added weight, limitations of space, difficulty of application and waste of materials.

SUMMARY OF THE INVENTION

It is, therefore, one object of the present invention to provide a thermal heat barrier for an exhaust system.

It is another object of the present invention to provide a thermal heat barrier for a catalytic converter and intake pipes of an exhaust system.

It is yet another object of the present invention to provide a thermal heat barrier which effectively and efficiently keeps the heat of the exhaust gases within the intake pipes and catalytic converter and away from the engine and/or passenger compartment of an automotive vehicle.

To achieve the foregoing objects, the present invention is an exhaust system. The exhaust system includes a catalytic converter formed of two half shells having flanged edge portions by which the two half shells can be welded together. Intake pipes directing the exhaust gases from an internal combustion engine to the catalytic converter are also formed of two half shells having flanged edge portions by which these half shells can be welded together. The exhaust system also includes a thermal barrier coating applied to the inside surface of the catalytic converter and intake pipes. Once the thermal barrier coating is applied, the half shells of both the catalytic converter and the intake pipes are welded together and to each other.

One advantage of the present invention is that the thermal barrier coating will efficiently contain the heat of the exhaust gases within the intake pipes and catalytic converter of the exhaust system. Another advantage of the present invention is that the thermal barrier coating and split exhaust system provides an effective and efficient means of keeping the heat of the exhaust gases within the intake pipes and catalytic converter.

Additional objects, advantages, and features of the present invention will become apparent from the following description and appended claims, taken in conjunction with the accompanying drawings.

BRIEF DESCRIPTION OF THE DRAWINGS

FIG. 1 is a perspective view of an exhaust system according to the present invention.

FIG. 2 is a cut-away view of one end of the exhaust system of FIG. 1 illustrating a catalytic converter accepting intake pipes.

FIG. 3 is a sectional view taken along lines 3—3 of FIG. 2.

DESCRIPTION OF THE PREFERRED EMBODIMENT(S)

Figure 4:
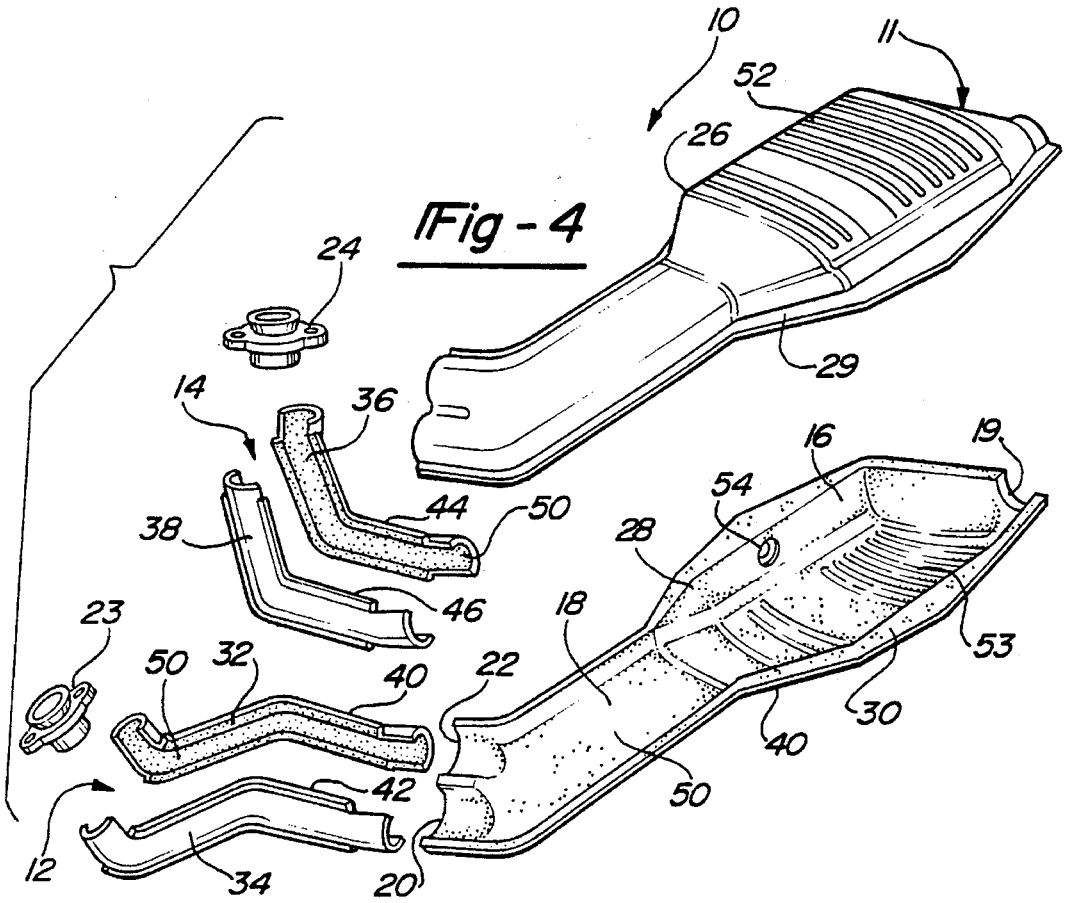
FIG. 4 is an exploded perspective view of the exhaust system of FIG. 1.

Referring to FIG. 1, an exhaust system 10 according to a preferred embodiment of the present invention is shown. The exhaust system 10 includes a catalytic converter, generally indicated at 11, and a pair of intake pipes, generally indicated at 12 and 14. The catalytic converter 11 has a first chamber 16 enclosing converter elements (not shown) for converting hazardous exhaust gases into harmless by-products, and a second chamber 18 for combining the hazardous exhaust gases from intake pipes 12 and 14 and directing the gases into one end of chamber 16. At another end of chamber 16 is an exit orifice 19 for accepting an exhaust pipe (not shown) for directing the harmless exhaust gas by-products from the catalytic converter 11 to the atmosphere. The catalytic converter 11 and intake pipes 12 and 14 are generally made out of steel.

The second chamber 18 has one end integrally formed with chamber 16 and another end having inlet orifices 20 and 22 for accepting intake pipes 12 and 14, respectively. One end of intake pipes 12 and 14 fit into orifices 20 and 22 and are welded there by well known means. At another end of intake pipes 12 and 14 are coupling devices 23 and 24, respectively. Coupling devices 23 and 24 couple intake pipes 12 and 14 to the manifolds (not shown) of an internal combustion engine (not shown). The catalytic converter system of FIG. 1 is for a specific eight (8)-cylinder internal combustion engine. It should be understood that other catalytic converter systems are known, including a single manifold that can be used with a single intake pipe and a single orifice into chamber 18, which could be the subject of the present invention.

Exhaust gases leaving the cylinders of the internal combustion engine are collected by the manifolds. The manifolds then direct the exhaust gases into intake pipes 12 and 14 through coupling devices 23 and 24, respectively. Intake pipes 12 and 14 direct the exhaust gases into catalytic converter 11 through the orifices 20 and 22 of chamber 18. The exhaust gases traveling through chamber 18 are introduced into chamber 16 in which the conversion process is conducted by well known means which need not be discussed here. U.S. Pat. No. 4,347,219 to Noritake et al discloses one method of using a catalyst substrate in a catalytic converter to convert harmful exhaust fumes into harmless by-products, the disclosed material of which is hereby incorporated by reference. Once the exhaust gases are converted, the exhaust gases leave chamber 16 through orifice 19 into an exhaust pipe (not shown).

According to a preferred embodiment of the present invention, catalytic converter 11 is formed by two half shells 26 and 28, as seen in FIG. 4. Catalytic converter half shell 26 has an edge portion configured to form a flange 29, and catalytic converter half shell 28 has an edge portion configured to form a flange 30 such that when half shell 26 and half shell 28 are combined to form a full shell, flange 29 lines up with flange 30 to form a weld area. Both flanges 29 and 30 generally follow the entire perimeter of half shells 26 and 28, except at orifices 20, 22 and 19. Flange 29 and flange 30 can be welded together by well known suitable welding means such as MIG or laser welding.

Intake pipes 12 and 14 are also formed from half shells 32 and 34, and 36 and 38, respectively. In addition, intake pipe 12 has a first half shell 32 and a second half shell 34 having flanged edge portions 40 and 42, respectively. Flanged edge portions 40 and 42 represent a weld area such that half shells 32 and 34 can be combined to form intake pipe 12 in a welding manner as described above. Likewise, intake pipe 14 has half shells 36 and 38 having flanged edge portions 44 and 46. Flanged edge portions 44 and 46 form a weld area for combining half shells 36 and 38 to form intake pipe 14. All of flanged edge portions 40 and 42, and flanged edge portions 44 and 46 run along the entire length of half shells 32 and 34, and 36 and 38, respectively.

Catalytic converter 11, intake pipe 12 and intake pipe 14 are formed by combining the half shells as described above in order to enable a thermal barrier coating 50 to be applied to the inside surface of catalytic converter 11, intake pipe 12 and intake pipe 14 in an even and efficient manner. Thermal barrier coating 50 forms a heat barrier against the transfer of heat from within the intake pipes 12 and 14 and catalytic converter 11 to the environment. As can be seen in FIG. 4, thermal barrier coating 50 is applied to the entire inside surface of intake pipes 12 and 14 and catalytic converter 11. The thermal barrier coating 50 is applied to the inside of intake pipes 12 and 14 and catalytic converter 11 by means of an arc plasma spray described hereunder, and provides a novel and efficient method of reducing the heat transfer from the inside of the intake pipes 12 and 14 and catalytic converter 11 to the environment. The thermal barrier coating 50 is generally made of a ceramic material, such as zirconia, and has a thickness calculated from the amount of heat expected within the exhaust gases resulting from the engine size, etc.

Half shell 26 of catalytic converter 11 has ridges 52 and half shell 28 has ridges 53 for positioning catalytic converter substrates (not shown), generally in a honeycomb configuration once half shells 26 and 28 have been welded together. Ridges 52 and 53 position the honeycomb substrates within chamber 16 perpendicular to the flow of exhaust gases through catalytic converter 11. Also included in half shell 28, is orifice 54 for accepting an air tube 56. Orifice 54 is positioned intermediate ridges 53, such that the honeycomb substrates will be positioned on both sides of orifice 54.

Figure 5:
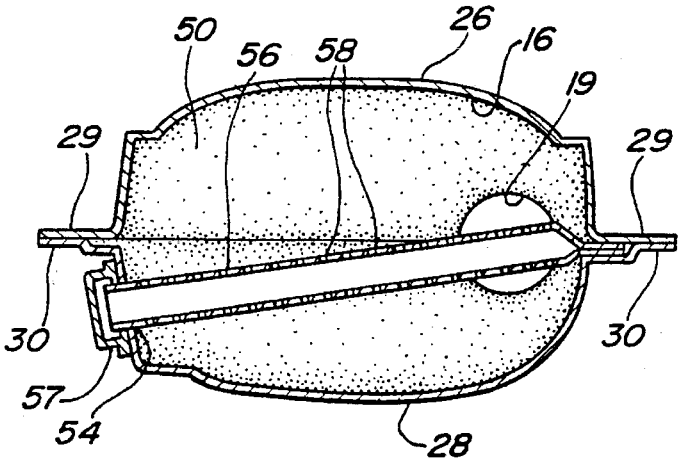
FIG. 5 is a sectional view taken along lines 5—5 of FIG. 1.

Referring to FIG. 5, half shells 26 and 28 have been welded together as described above by means of welding along flanges 29 and 30, to form chambers 16 and 18. Within chamber 16 and inserted through orifice 54 is an air tube 56. At one end of air tube 56 at the outside of chamber 16 is an air tube fitting 57. Air tube fitting 57 accepts an air hose (not shown) from an air pump (not shown) for admitting air into chamber 16 through air tube 56. The end of air tube 56 opposite air tube fitting 57 is pinched closed and welded between flanges 29 and 30 to hold it in place when half shells 26 and 28 are welded together, as shown. Located along air tube 56 within chamber 16 are a plurality of apertures 58 for introducing the air from the air pump into chamber 16. As is well known in the art, oxygen in the air combines with the exhaust gases to enhance the conversion of the exhaust gases into harmless exhaust fumes.

In operation, exhaust gases leaving the internal combustion engine conthin a certain amount of heat due to the operation of the engine. As the heated exhaust gases start traveling down the exhaust system 10 they are introduced into intake pipes 12 and 14. Since intake pipes 12 and 14 are coated with thermal barrier coating 50 on the inside, the heat within the exhaust gases is contained within the intake pipes 12 and 14. The exhaust gases are then introduced into catalytic converter 11 through orifices 20 and 22 at relatively the same temperature they were introduced into the intake pipes 12 and 14. Catalytic converter 11 also is coated with thermal barrier coating 50 on the inside and thus the heat of the exhaust gases is further maintained as the exhaust gases travel through chamber 18 of catalytic converter 11. Therefore, once the exhaust gases reach the catalyst substrate in chamber 16 of catalytic converter 11, the exhaust gases are at relatively the same temperature as when they left the internal combustion engine.

The maintenance of the heat integrity of the exhaust gases and the introduction of air into chamber 16 through air tube 56 increases the conversion efficiency of the exhaust gases into harmless by-products and thus makes the automotive vehicle more environmentally sound. The incorporation of the thermal barrier coating 50 is especially effective during engine start up, before the catalytic converter 11 is at its normal operating temperature, because of the high heat conduction of the steel components when they are cold. It is within the scope of the present invention to apply the thermal barrier coating 50 to the inside surface of the manifolds to further increase the maintenance of the heat integrity of the exhaust gases.

Now turning to FIG. 2, the end of chamber 18 having orifices 20 and 22 for accepting inlet pipes 12 and 14 is shown. First and second shells 26 and 28 are combined by welding as described above to form chamber 16 and 18. Points 60 and 64 show spot welding positions along flanges 29 and 30 for combining shells 26 and 28. Points 66 show spot welding positions between inlet pipes 12 and 14 to completely close off the end of chamber 18 opposite chamber 16 except for orifices 20 and 22. Intake pipes 12 and 14 are then inserted into orifices 20 and 22, respectively until the flanges 40 and 42 of intake pipe 12 and flanges 44 and 46 of intake pipe 14 contact the edge of changer 18 formed by orifices 20 and 22. Intake pipes 12 and 14 are then mounted in this position by well known suitable methods such as MIG welding or laser welding to form a weld area 68 completely around the circumference of both intake pipes 12 and 14. Therefore, no exhaust gases or exhaust gas heat can escape at orifices 20 and 22.

Half shells 32 and 34 of intake pipe 12 and half shells 36 and 38 of intake pipe 14 are combined by means similar to spot weld 60, 64 and 66 along flanged edge portions 40 and 42 of intake pipe 12 and flanged edge portions 44 and 46 of intake pipe 14. This spot welding of intake pipes 12 and 14 is completed prior to inserting intake pipes 12 and 14 into orifices 20 and 22. It will be understood that dual intake pipes 12 and 14 is a matter of design choice for a specific engine and automotive vehicle exhaust system, and will not limit the application of the thermal barrier coating 50 according to the present invention. Single intake pipes into a catalytic converter are well known in the art and are entirely applicable to the present invention.

Referring to FIG. 3, intake pipes 12 and 14 as positioned within orifices 20 and 22 of chamber 18. The relationship of flanged edge portions 44 and 46 of intake pipe 14 and flanged edge portions 40 and 42 of intake pipe 12 is shown relative to flanges 29 and 30 of chamber 18. Such an orientation is completely arbitrary as intake pipes 12 and 14 can be turned within orifices 20 and 22, prior to application of welds 66, in any position which enables coupling devices 23 and 24 to be lined up with the manifolds of the internal combustion engine. As can be seen, thermal barrier coating 50 completely covers the entire inner surface of intake pipes 12 and 14. Since the inside surface of catalytic converter 11 is also completely covered by thermal barrier coating 50, there is no area at the orifices 20 and 22 which does not have a thermal barrier coating 50 when intake pipes 12 and 14 are inserted into orifices 20 and 22. Chamber 18 provides an adequate open area by which the exhaust gases from intake pipes 12 and 14 can be combined without creating any back pressure.

Figure 6:
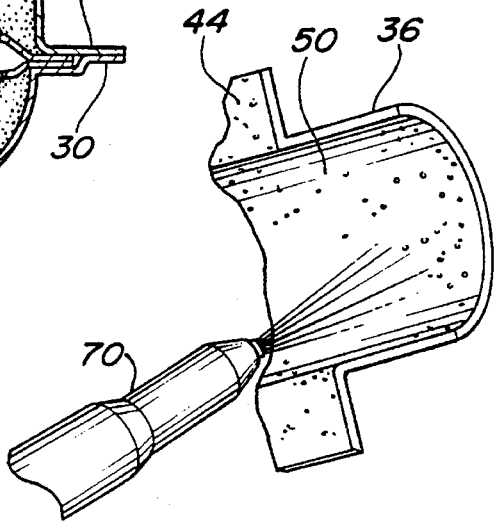
FIG. 6 is a cut-away perspective view of one end of one of an intake pipe showing the application of a thermal barrier.

Referring to FIG. 6, the application of the thermal barrier coating 50 according to one preferred embodiment of the present invention is shown. In that figure, half shell 36 of intake pipe 14 is shown having flanged edge portion 44. Application of thermal barrier coating 50 is conducted by arc plasma source 70 prior to combining half shell 36 with half shell 38 to form intake pipe 14, and prior to intake pipe 14 being inserted into orifice 22. The remaining half shell 38 is also coated with thermal barrier coating 50, as well as both half shells of intake pipe 12 and catalytic converter 11. Catalytic converter 11, as well as intake pipes 12 and 14, are formed in combinable half shell portions such that thermal barrier coating 50 can be applied to the inside surfaces of intake pipes 12 and 14 in catalytic converter 11 by source 70 in an efficient and even fashion. By such a process, thermal barrier coating 50 can be applied to every surface of the inside of half shell 26 and 28 of catalytic converter 11 and shells 36 and 38 of intake pipe 14 as well as shells 32 and 34 of intake pipe 12 with the same degree of thickness. Thus the thermal qualities of thermal barrier coating 50, and thus the heat resistance of the exhaust system 10, is constant throughout the entire exhaust system 10.

Arc plasma source 70 is well known to those skilled in the art, and its operation need not be described here. To adhere thermal barrier coating 50 to catalytic converter 11 and intake pipes 12 and 14, a bonding layer must first be applied. The bonding layer, such as NiCrAlY, is applied to the inside surface of catalytic converter 11 and intake pipes 12 and 14 by source 70. Generally a layer having a thickness of one five-thousandths of an inch is sufficient to bend the thermal barrier coating 50 to the steel of the catalytic converter 11 and intake pipes 12 and 14. The bonding agent is sprayed from source 70 in the form of a liquid spray. The bonding layer is then dried by well known means. Next the thermal barrier coating 50 is sprayed from source 70 in the same manner. Thermal barrier coating 50 is also in the form of a liquid spray, generally a zirconia ceramic liquid spray. The thickness of thermal barrier coating 50 is a factor of the exhaust system 10 and the amount of heat resulting from the specific internal combustion engine. The thermal barrier coating 50 is also dried by well known means. Thermal barrier coating 50 will therefore be evenly and permanently adhered to catalytic converter 11 and intake pipes 12 and 14 to efficiently keep the heat within the exhaust system 10 for the life of the system.

The use of an arc plasma source to spray a ceramic thermal barrier to the inside surface of a catalytic converter formed by half shells provides an efficient and simple method of getting an even layer of the thermal barrier coating throughout the exhaust system. The arc plasma spray is highly controllable to get the desirable thickness of the thermal barrier coating to keep the heat within the exhaust system at all locations. The thermal barrier coating will insulate the catalytic converter from the high temperature and corrosive by-products of the exhaust gases. The heat trapped in the catalytic converter will enhance the conversion process of the catalyst substrate and keep the heat from entering the engine or passenger compartment of the automotive vehicle.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An exhaust system comprising:

a catalytic converter formed from a first half shell and a second half shell, said first and second half shells having an inside and an outside surface;

at least one intake pipe formed from a first half shell and a second half shell, said first and second half shells of said intake pipe having an inside and an outside surface; and wherein the inside surface of the first and second half shells of the catalytic converter is coated with a thermal barrier coating by means of an arc plasma spray.

2. The exhaust system of claim 1 wherein the thermal barrier coating is a zirconia ceramic.

3. The exhaust system of claim 1 further comprising an air tube, said air tube positioned within the catalytic converter and including a plurality of apertures.

4. The exhaust system of claim 1 wherein each half shell of the catalytic converter and each half shell of the intake pipe is made of steel and the first and second half shells of the catalytic converter are welded together and the first and second half shells of the intake pipe are welded together.

5. A catalytic converter exhaust system comprising:

a catalytic converter formed from two half shells, said half shells having a flanged edge portion forming a weld area;

at least one intake pipe formed from two half shells, the half shells of the at least one intake pipe having a flanged edge portion forming a weld area;

a thermal barrier coating applied to an inside surface of the half shells of the catalytic converter and the half shells of the at least one intake pipe; and wherein the thermal barrier coating is adhered to the inside surface by means of a bonding agent, said bonding agent being applied by means of an arc plasma spray.

6. The catalytic converter exhaust system of claim 5 wherein the thermal barrier coating is a zirconia ceramic.

7. The catalytic converter system of claim 5 wherein the half shells of the catalytic converter are welded together along the weld area of the catalytic converter and the half shells of the at least one intake pipe are welded together along the weld area of the at least one intake pipe.

8. A method of making a catalytic converter exhaust system comprising the steps of:

forming a catalytic converter and at least one intake pipe into two separate half shells;

spraying a bonding agent to the inside surface of each of the two half shells of the catalytic converter by means of an arc plasma source;

spraying a thermal barrier coating by means of an arc plasma source on the bonding agent which is adhered to the inside surface of each of the two half shells of the catalytic converter; and combining the two half shells of the catalytic converter and the two half shells of the at least one intake pipe.

9. The method of claim 8 wherein the step of combining the half shells includes welding the half shells of the catalytic converter together and welding the half shells of the at least one intake pipe together along flanged edge portions.

10. The method of claim 9 wherein the step of combining includes welding the at least one intake pipe to an orifice of the catalytic converter after the half shells of the catalytic converter have been welded together and the half shells of the at least one intake pipe have been welded together.

11. The method of claim 8 wherein the step of spraying includes spraying a ceramic thermal barrier coating.

* * * * *